US010259684B2

(12) United States Patent
Papas et al.

(10) Patent No.: US 10,259,684 B2
(45) Date of Patent: Apr. 16, 2019

(54) FIRE RESISTANT COATED STEEL BELT

(71) Applicant: OTIS ELEVATOR COMPANY, Farmington, CT (US)

(72) Inventors: Paul Papas, West Hartford, CT (US); Michael R. Carey, East Hampton, CT (US); Daniel A. Mosher, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/843,289

(22) Filed: Dec. 15, 2017

(65) Prior Publication Data

US 2018/0105392 A1 Apr. 19, 2018

Related U.S. Application Data

(62) Division of application No. 15/148,288, filed on May 6, 2016, now Pat. No. 9,873,593.

(Continued)

(51) Int. Cl.
*B66B 7/06* (2006.01)
*D07B 1/16* (2006.01)

(Continued)

(52) U.S. Cl.
CPC ..... *B66B 7/062* (2013.01); *D07B 1/16* (2013.01); *D07B 1/162* (2013.01); *D07B 7/145* (2013.01);

(Continued)

(58) Field of Classification Search
CPC ..... B66B 7/062; D07B 1/16; D07B 1/162; D07B 7/145; H05K 999/99
See application file for complete search history.

(56) References Cited

U.S. PATENT DOCUMENTS 3,200,662 A * 8/1965 Huber ..... B29B 13/023 156/137
5,119,927 A * 6/1992 Bruggemann ..... B65G 15/34 198/846

(Continued)

FOREIGN PATENT DOCUMENTS

CN 101085655 A 12/2007
CN 203300263 U 11/2013

(Continued)

OTHER PUBLICATIONS

EP European Search Report in EP Application No. 16168584.7; dated Oct. 13, 2016; 10 pages.

*Primary Examiner* — Michael A Riegelman
(74) *Attorney, Agent, or Firm* — Cantor Colburn LLP

(57) ABSTRACT

A belt for suspending and/or driving an elevator car of an elevator system includes a plurality of tension members arranged in a lengthwise direction and a jacket substantially retaining the plurality of tension members. The jacket includes a traction portion, a back portion, and an inner portion between the traction portion and the back portion. The traction portion is formed from a first material and the inner portion is formed from a second material having an increased fire resistance compared to the first material. A method of forming an elevator system belt includes arranging a plurality of tension members in a lengthwise direction and securing the plurality of tension members in a jacket by at least partially enclosing the plurality of tension members in the jacket. The jacket includes a traction portion, a back portion, and an inner portion having a greater fire resistance than the traction portion.

8 Claims, 7 Drawing Sheets

Related U.S. Application Data

(60) Provisional application No. 62/158,059, filed on May 7, 2015.

(51) Int. Cl.
*D07B 7/14* (2006.01)
*D07B 1/22* (2006.01)

(52) U.S. Cl.
CPC ..... *D07B 1/22* (2013.01); *D07B 2201/2087* (2013.01); *D07B 2201/2092* (2013.01); *D07B 2401/2035* (2013.01); *D07B 2501/2007* (2013.01)

(56) References Cited

U.S. PATENT DOCUMENTS 5,584,897 A * 12/1996 Christianson ..... B24D 11/02 156/137
6,164,053 A * 12/2000 O'Donnell ..... B66B 7/06 187/251
6,419,775 B1 * 7/2002 Gibson ..... B32B 25/10 156/137
7,041,021 B2 5/2006 Gibson et al.
9,873,593 B2 * 1/2018 Papas ..... B66B 7/062
2008/0073156 A1 * 3/2008 Ach ..... B29D 29/10 187/250
2010/0240482 A1 * 9/2010 Kanzow ..... F16G 5/08 474/237
2011/0100759 A1 * 5/2011 Yu ..... B66B 7/062 187/251
2011/0108372 A1 * 5/2011 Krishnan ..... B66B 7/062 187/411
2011/0259677 A1 * 10/2011 Dudde ..... B66B 7/062 187/411
2012/0329591 A1 * 12/2012 Goeser ..... B66B 7/062 474/238
2014/0015168 A1 * 1/2014 Krishnan ..... B29C 63/22 264/279
2014/0076669 A1 * 3/2014 Wesson ..... B66B 7/062 187/254
2014/0302316 A1 10/2014 Gallens et al.
2015/0191331 A1 * 7/2015 Orelup ..... D07B 1/22 428/76
2015/0259176 A1 * 9/2015 Goeser ..... B66B 7/062 428/189
2017/0225925 A1 * 8/2017 Wesson ..... B66B 7/062
2017/0240382 A1 * 8/2017 Orelup ..... B66B 7/062
2017/0283219 A1 * 10/2017 Ding ..... B29D 29/00
2017/0283220 A1 * 10/2017 Ding ..... B66B 7/062
2017/0284503 A1 * 10/2017 Goser ..... B66B 7/062
2018/0044137 A1 * 2/2018 Pelto-Huikko ..... D07B 5/10
2018/0105392 A1 * 4/2018 Papas ..... B66B 7/062
2018/0127239 A1 * 5/2018 Zafiris ..... B66B 7/062
2018/0127240 A1 * 5/2018 Zafiris ..... D07B 1/22
2018/0162695 A1 * 6/2018 Eastman ..... B66B 7/062

FOREIGN PATENT DOCUMENTS

CN 203812639 U 9/2014
DE 102012110769 A1 5/2014
EP 1886796 A1 2/2008
JP 2002231070 A 8/2002
WO 9816681 A2 4/1984
WO 2014014456 A1 1/2014
WO 2014072093 A1 5/2014

* cited by examiner

FIRE RESISTANT COATED STEEL BELT

CROSS-REFERENCE TO RELATED APPLICATIONS

This application is a divisional application of U.S. patent application Ser. No. 15/148,288 filed May 6, 2016, and further claims the benefit of an earlier filing date from U.S. Provisional Application Ser. No. 62/158,059 filed May 7, 2015, the contents of which are incorporated by reference herein in their entirety.

BACKGROUND

The subject matter disclosed herein relates to elevator systems. More specifically, the subject disclosure relates to tension members for elevator suspension and/or driving.

Elevator systems utilize a lifting means, such as ropes or belts operably connected to an elevator car, and routed over one or more sheaves, also known as pulleys, to propel the elevator along a hoistway. Lifting belts in particular typically include a plurality of wires at least partially within a jacket material. The plurality of wires are often arranged into one or more strands and the strands are then arranged into one or more cords.

Lifting belts may be required to meet certain established standards to be certified for fire resistance, and/or may require the installation of fire mitigation systems. Thus, the jacket material is often formed of a material with increased fire resistant properties at the outer surface of the belt. Such materials, however, can have non-optimal wear durability and other mechanical performance characteristics.

BRIEF SUMMARY

In one embodiment, a belt for suspending and/or driving an elevator car of an elevator system includes a plurality of tension members arranged in a lengthwise direction and a jacket substantially retaining the plurality of tension members. The jacket includes a traction portion, a back portion, and an inner portion between the traction portion and the back portion. The traction portion is formed from a first material and the inner portion is formed from a second material having an increased fire resistance compared to the first material.

Additionally or alternatively, in this or other embodiments one or more intermediate layers are located between the traction portion and the inner portion, and/or between the inner portion and the back portion.

Additionally or alternatively, in this or other embodiments the one or more intermediate layers are formed from a fiberglass fabric, another fire resistant fabric, or a wire metal mesh.

Additionally or alternatively, in this or other embodiments the back portion has increased fire resistance relative to the traction portion.

Additionally or alternatively, in this or other embodiments the traction portion and the back portion are formed from the same material.

Additionally or alternatively, in this or other embodiments an edge treatment is located at one or more lateral edges of the belt to increase fire resistance of the lateral edges.

Additionally or alternatively, in this or other embodiments the edge treatment includes a layer of material located at one or more lateral edges of the belt having increased fire resistance relative to the traction portion.

Additionally or alternatively, in this or other embodiments the layer of material is formed from the second material.

Additionally or alternatively, in this or other embodiments the edge treatment extends in board partially along the traction portion and/or the back portion.

Additionally or alternatively, in this or other embodiments the edge treatment includes an at least partially exposed tension member.

Additionally or alternatively, in this or other embodiments the tension member is one of a cord formed from a plurality of metal wires, or metallic strips located at the edge portion Additionally or alternatively, in this or other embodiments the edge treatment has a C-shaped cross-section and mechanically interlocks with the jacket.

Additionally or alternatively, in this or other embodiments the edge treatment is preformed and secured to the jacket during formation of the jacket.

In another embodiment, an elevator system includes an elevator car movable along a hoistway, a machine located in the hoistway to drive rotation of a traction sheave, and a belt operably connected to the elevator car and interactive with the traction sheave such that rotation of the traction sheave drives movement of the elevator car along the hoistway. The belt includes a plurality of tension members arranged in a lengthwise direction and a jacket substantially retaining the plurality of tension members. The jacket defines a traction portion interactive with the traction sheave, a back portion, and an inner portion between the traction portion and the back portion. The traction portion is formed from a first material and the inner portion is formed from a second material having an increased fire resistance compared to the first material.

Additionally or alternatively, in this or other embodiments one or more intermediate layers are located between the traction portion and the inner portion, and/or between the inner portion and the back portion.

Additionally or alternatively, in this or other embodiments the one or more intermediate layers are formed from a fiberglass fabric, another fire resistant fabric, or a wire metal mesh.

Additionally or alternatively, in this or other embodiments the back portion has increased fire resistance relative to the traction portion.

Additionally or alternatively, in this or other embodiments the back portion and the traction portion are formed from the same material.

Additionally or alternatively, in this or other embodiments an edge treatment is positioned at one or more lateral edges of the belt to increase fire resistance of the lateral edges.

Additionally or alternatively, in this or other embodiments the edge treatment comprises a layer of material having increased fire resistance relative to the traction and/or back portions.

Additionally or alternatively, in this or other embodiments the layer of material is formed from the second material.

Additionally or alternatively, in this or other embodiments the edge treatment extends partially along the traction portion.

Additionally or alternatively, in this or other embodiments the edge treatment includes an at least partially exposed tension member.

In yet another embodiment, a method of forming an elevator system belt includes arranging a plurality of tension members in a lengthwise direction and securing the plurality of tension members in a jacket by at least partially enclosing the plurality of tension members in the jacket. The jacket includes a traction portion, a back portion, and an inner portion having a greater fire resistance than the traction portion.

Additionally or alternatively, in this or other embodiments the jacket is trimmed to expose the inner portion at a lateral edge of the jacket thus forming an edge treatment having an increased fire resistance.

Additionally or alternatively, in this or other embodiments one or more fire retardant edge portions are formed, and the one or more edge portions are secured to one or more lateral edges of the jacket.

Additionally or alternatively, in this or other embodiments the one or more edge portions are preformed, and the one or more edge portions are guided into a forming tool together with the plurality of tension members. The plurality of tension members are at least partially enclosed in the jacket at the forming tool, and the one or more preformed edge portions are secured to the jacket at the forming tool.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION

Figure 1A:
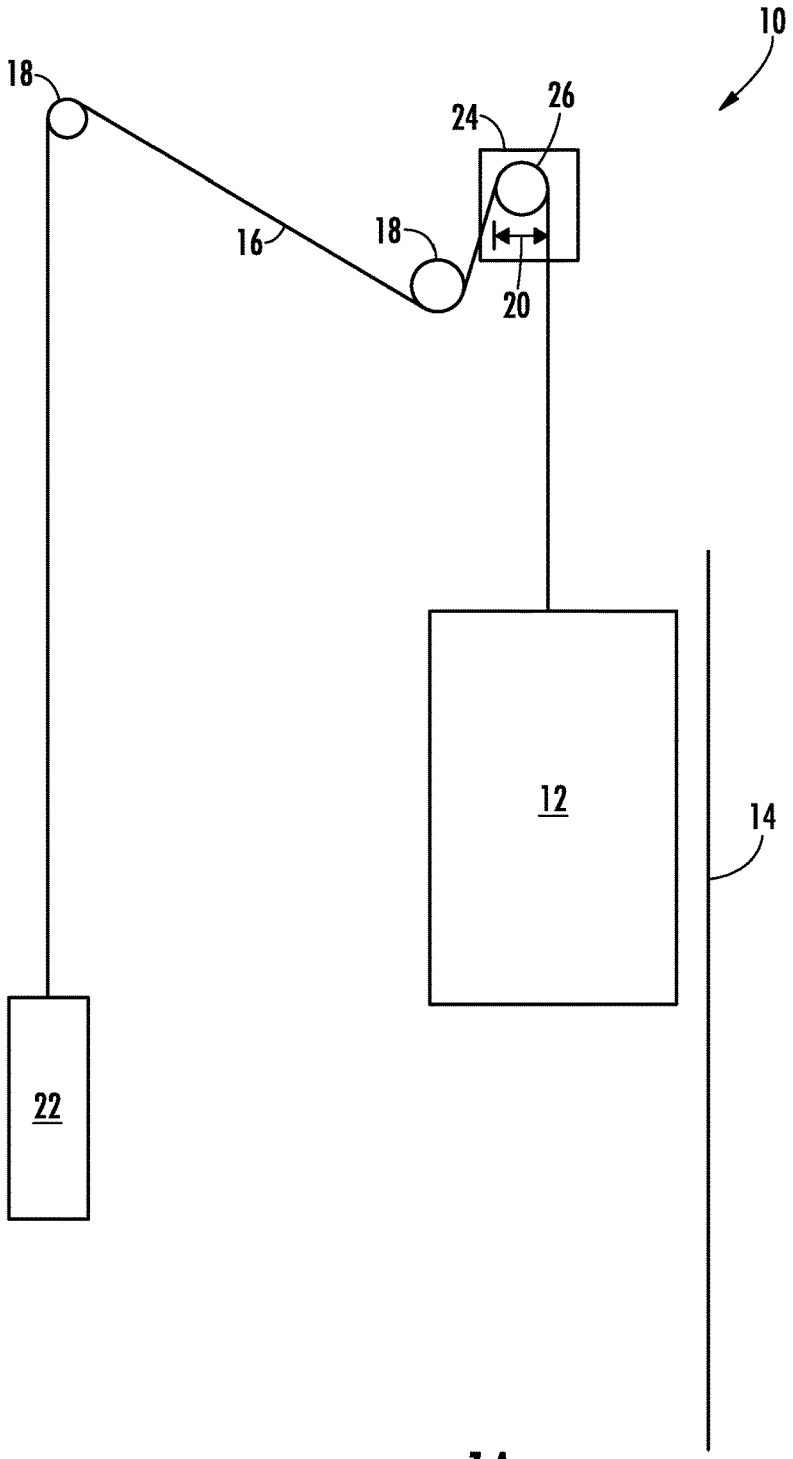
FIG. 1A is a schematic view of an exemplary embodiment of a traction elevator system.
Figure 1B:
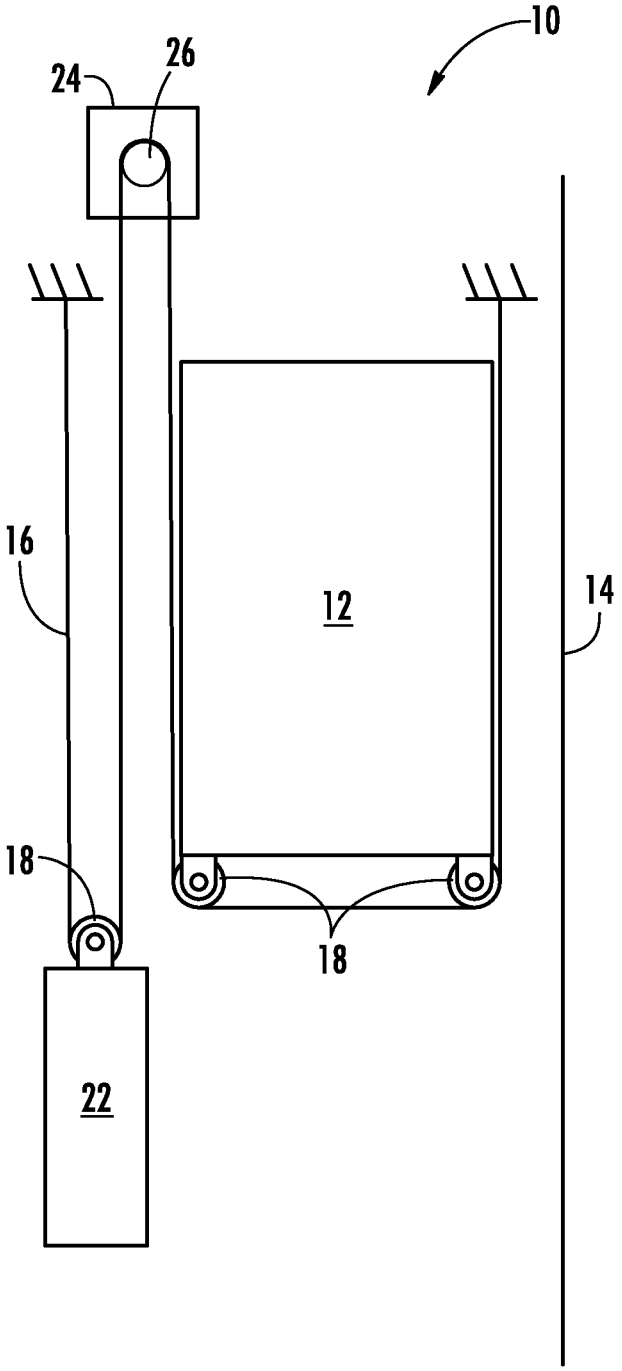
FIG. 1B is a schematic view of another exemplary embodiment of a traction elevator system.
Figure 1C:
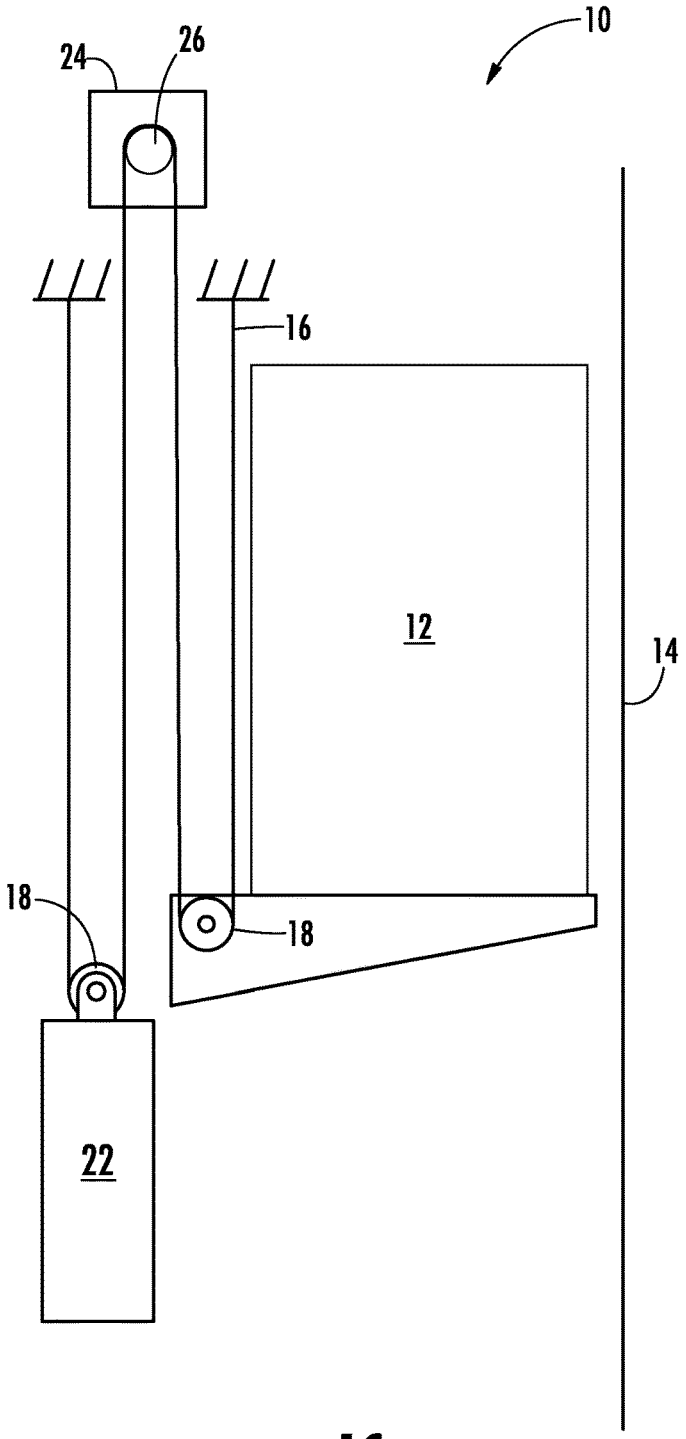
FIG. 1C is a schematic view of yet another embodiment of a traction elevator system.

Shown in FIGS. 1A, 1B and 1C are schematics of exemplary traction elevator systems 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more belts 16. The one or more belts 16 interact with one or more sheaves 18 to be routed around various components of the elevator system 10. The one or more belts 16 could also be connected to a counterweight 22, which is used to help balance the elevator system 10 and reduce the difference in belt tension on both sides of the traction sheave during operation.

The sheaves 18 each have a diameter 20, which may be the same or different than the diameters of the other sheaves 18 in the elevator system 10. At least one of the sheaves could be a drive sheave 26. The drive sheave 26 is driven by a machine 24. Movement of the drive sheave 26 by the machine 24 drives, moves and/or propels (through traction) the one or more belts 16 that are routed around the drive sheave 26.

At least one of the sheaves 18 could be a diverter, deflector or idler sheave 18. Diverter, deflector or idler sheaves 18 are not driven by the machine 24, but help guide the one or more belts 16 around the various components of the elevator system 10.

In some embodiments, the elevator system 10 could use two or more belts 16 for suspending and/or driving the elevator car 12. In addition, the elevator system 10 could have various configurations such that either both sides of the one or more belts 16 engage the one or more sheaves 18 (such as shown in the exemplary elevator systems in FIG. 1A, 1B or 1C) or only one side of the one or more belts 16 engages the one or more sheaves 18.

FIG. 1A provides a 1:1 roping arrangement in which the one or more belts 16 terminate at the car 12 and counterweight 22. FIGS. 1B and 1C provide different roping arrangements. Specifically, FIGS. 1B and 1C show that the car 12 and/or the counterweight 22 can have one or more sheaves 18 thereon engaging the one or more belts 16 and the one or more belts 16 can terminate elsewhere, typically at a structure within the hoistway 14 (such as for a machine roomless elevator system) or within the machine room (for elevator systems utilizing a machine room. The number of sheaves 18 used in the arrangement determines the specific roping ratio (e.g. the 2:1 roping ratio shown in FIGS. 1B and 1C or a different ratio). One skilled in the art will readily appreciate that the configurations of the present disclosure could be used on elevator systems other than the exemplary types shown in FIGS. 1A, 1B and 1C.

Figure 2:
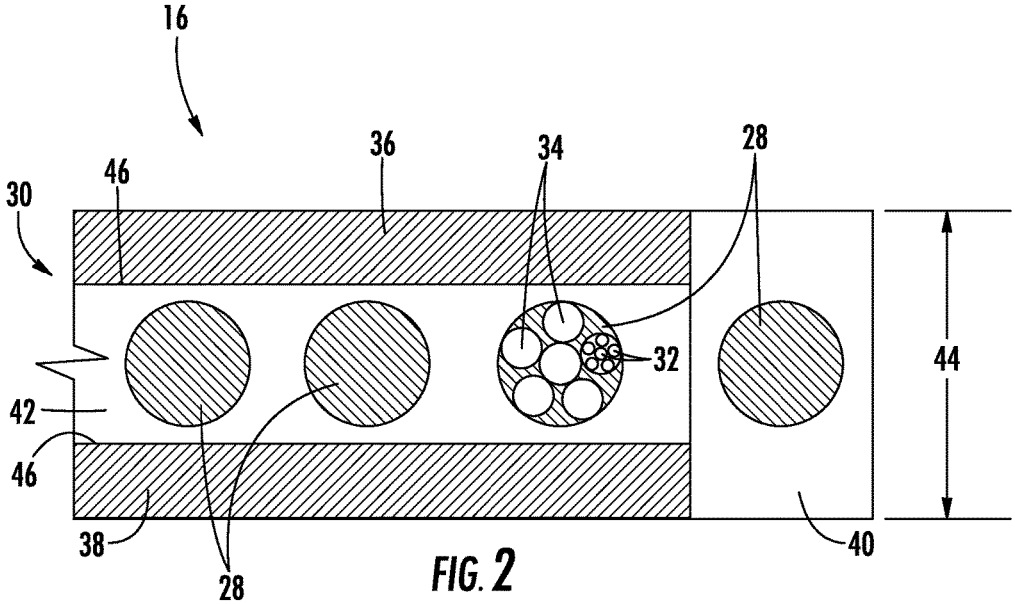
FIG. 2 is cross-sectional view of an embodiment of a belt for a traction elevator system.

Referring to FIG. 2, a cross-sectional view of an exemplary belt 16 is shown. The belt 16 is constructed of one or more cords 28 in a jacket 30. The cords 28 of the belt 16 may all be identical, or some or all of the cords 28 used in the belt 16 could be different than the other cords 28. For example, one or more of the cords 28 could have a different construction, formed from different materials, or size than the other cords 28. As seen in FIG. 2, the belt 16 has an aspect ratio greater than one (i.e. belt width is greater than belt thickness). Each cord 28 comprises a plurality of wires 32, which in some embodiments are formed into strands 34, which are then formed into the cord 28.

The belt 16 is constructed to have sufficient flexibility when passing over the one or more sheaves 18 to provide low bending stresses, meet belt life requirements and have smooth operation, while being sufficiently strong to be capable of meeting strength requirements for suspending and/or driving the elevator car 12.

The jacket 30 includes a traction portion 36 interactive with and contacting the drive sheave 26 and a back portion 38 opposite the traction portion 36. Further, a width of the belt 16 is defined by edge portions 40. An inner portion 42 of the belt 16 may be located between the traction portion 36 and the back portion 38. The traction portion 36 and back portion 38 each have thicknesses extending across a thickness of the belt 16 so that the desired materials of the traction portion 36 and back portion 38 are present at these locations over a service life of the belt 16.

The jacket 30, for example, inner portion 42, can substantially retain the cords 28 therein. The phrase substantially retain means that the jacket 30 has sufficient engagement with the cords 28 such that the cords 28 do not pull out of, detach from, and/or cut through the jacket 30 during the application on the belt 16 of a load that can be encountered during use in an elevator system 10 with, potentially, an additional factor of safety. In other words, the cords 28 remain at their original positions relative to the jacket 30 during use in an elevator system 10. The jacket 30 could completely envelop the cords 28 (such as shown in FIG. 2), substantially envelop the cords 28, or at least partially envelop the cords 28.

The portions 36, 38, 40 and 42 of the jacket 30 may be formed from a number of different materials. For example, in one embodiment, the traction portion 36 is formed from a first material, for example a thermoplastic polyurethane (TPU) material. The first material has desired mechanical properties for desired traction, low noise and wear properties. Further, in embodiments of elevator systems 10 where the back surface 38 back portion 38 contacts sheaves 18, it may be desired to form back portion 38 from the first material to provide the same mechanical properties at the back portion 38 as at the traction portion 36.

As stated above, the inner portion 42 of the belt 16 is located between the traction portion 36 and the back portion 38. The inner portion 42 is configured to have a degree of fire resistance greater than the traction portion 36. The inner portion 42 may be formed from a second material, such as a material including a percentage of melamine cyanurate (MC) to increase its fire resistance relative to the traction portion 36 material. In some embodiments, the inner portion 42 is approximately 60% to 90% of a thickness 44 of the belt 16. The material layer thickness of the traction portion 36 and/or the back portion 38 may vary in thickness. Some embodiments may include an intermediate layer 46, for example, a fiberglass fabric or wire metal mesh between the traction portion 36 and the inner portion 42 or as a replacement for the inner portion 42. The intermediate layer 46 may be either embedded in the belt 16 or located at the back portion 38. The inner portion 42 and/or the intermediate layer 46 are positioned and configured to prevent burn through or melt through of the belt 16 thus leading to improved fire resistance of belt 16, while the traditional first material is utilized at the traction portion 36 to provide the expected traction, noise level, wear rate and other properties of belt 16 operation.

Figure 3:
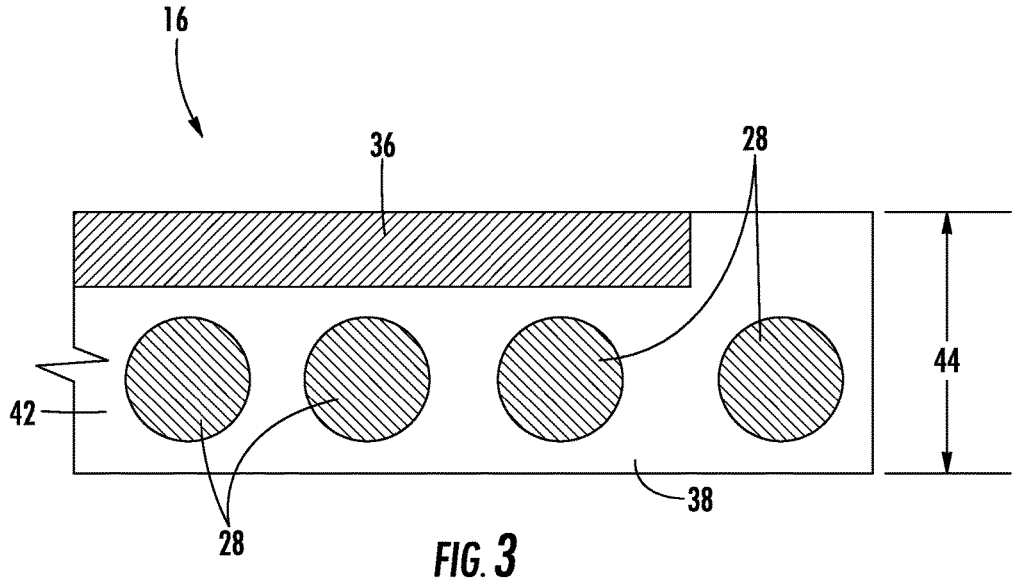
FIG. 3 is a cross-sectional view of another embodiment of a belt for a traction elevator system.

Referring to FIG. 3, in an alternate embodiment the traction portion 36 is formed from the first material, and the remaining thickness of the belt 16, extending to the back portion 38, is formed from the second material, the inner portion 42 extending from the traction portion 36 and extending to an defining the back portion 38.

Referring again to FIG. 2, embodiments may include one or more edge treatments to reduce the effect of flame spread and wraparound from the traction portion 36 to the back portion 38, or vice versa. In the embodiment of FIG. 2, the belt edge portion 40 are formed from the fire resistant second material, but in other embodiments may be formed from a different fire resistant material. The edge portion 40 extends inboard partially across the traction portion 36 and/or the back portion 38. It is desired to minimize the wraparound flame spread so that the fire resistance of the edge portion 40 is maintained while minimizing the impact on performance of the traction portion 36. In some embodiments, the edge portion 40 extends laterally inboard about 3 mm, but can vary according to desired performance.

Figure 4:
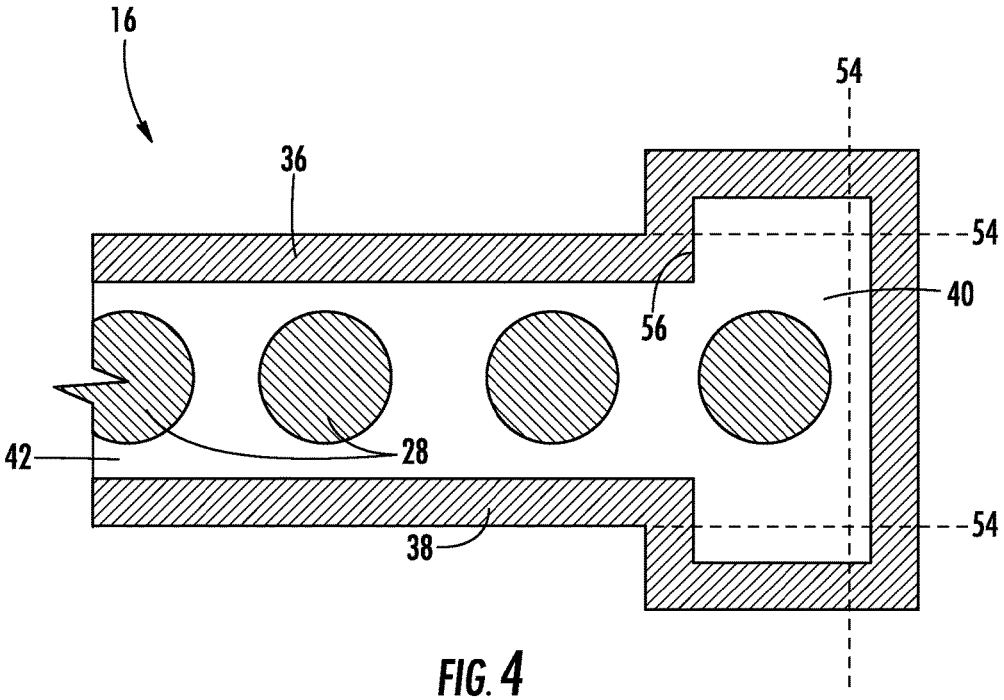
FIG. 4 is an illustration of a trimming process for an exemplary traction elevator belt.

The edge portions 40 may be formed in any one of several ways. One method of forming the edge portion 40 is illustrated in FIG. 4. In the embodiment of FIG. 4, the edge portion 40 is formed oversized in both thickness 50 and width 52, and may be formed via, for example, co-extrusion with the traction portion 36, the back portion 38 and the inner portion 42, or may be formed via a secondary extrusion or other process. After forming, the edge portion 40 is trimmed along trim lines 54 to a selected shape to expose the fire retardant material of the edge portion 40. The trimming operation allows for a well-defined transition area 56 between the first material of the traction portion 36 and the second material of the edge portion 40, and ensures a selected thickness of the first material at the transition area 56.

Figure 5:
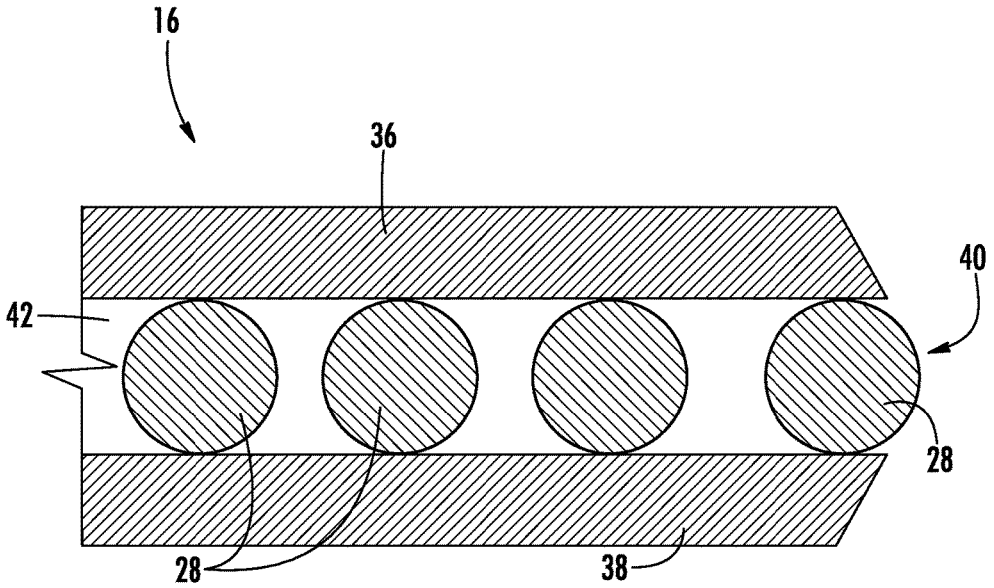
FIG. 5 is a cross-sectional view of still another embodiment of a traction elevator belt.

Referring now to FIG. 5, in another embodiment the edge portion 40 is formed by trimming or by extruding or otherwise forming the belt 16 so that at least a portion of an end cord 28 is exposed. The metal material of the cord 28 acts as a fire resistant material to protect the belt 16. In some embodiments, about 25% to 50% of a lateral width of the cord 28 is exposed, so the cord 28 provides fire resistance while still being securely retained in the jacket 30. The cord cross-section for these end cords could deviate from circular and, for example, could be constructed of metallic strips or other fire resistant materials.

Figure 6:
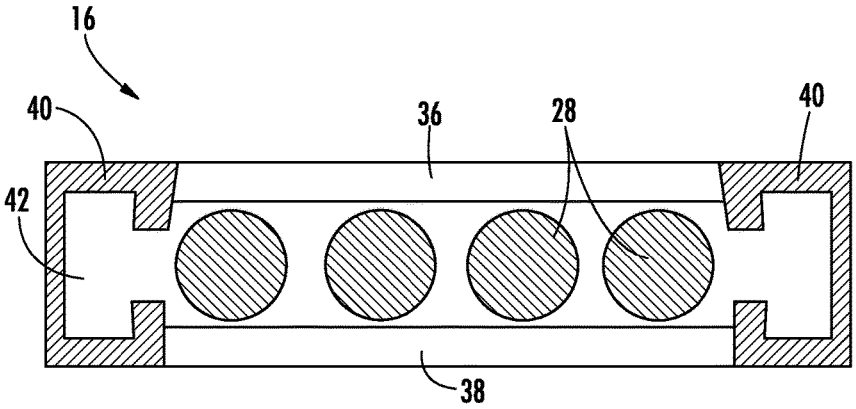
FIG. 6 is a cross-sectional view of another embodiment of a traction elevator belt.
Figure 7:
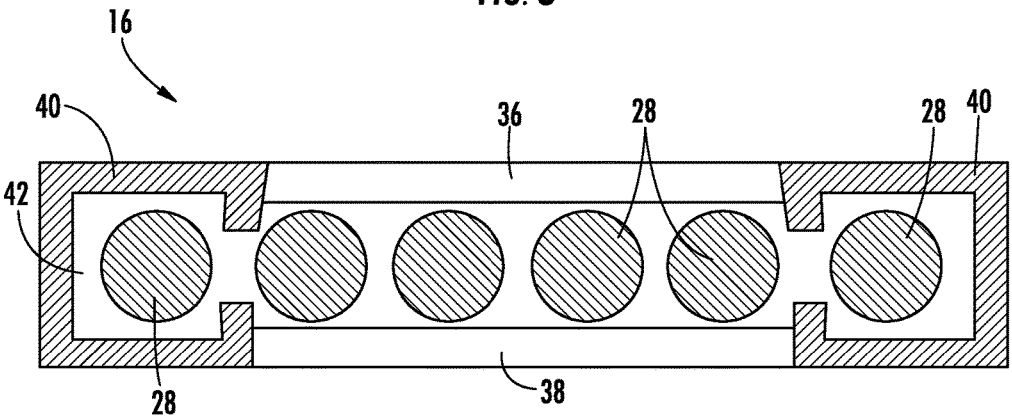
FIG. 7 is a cross-sectional view of yet another embodiment of a traction elevator belt.

In other embodiments of belt 16 shown in FIGS. 6 and 7, the edge portion 40 is pre-formed separately rather than being formed as the material flowing through the extruder screw in an extrusion process. The pre-formed edge portion 40 is then fed into the extrusion die along with the cords 18. The preformed edge portion 40 then joined to the other jacket portions 36, 38, 42 of the belt 16 via a combination of adhesion and mechanical interlocking. In the embodiments of FIGS. 6 and 7, the edge portion 40 is formed as a "C" geometry shape that achieves mechanical interlocking, but those skilled in the art will readily appreciate that edge portions 40 may be formed to other geometric shapes. In some embodiments, such as in FIG. 7, one or more cords 18 may be positioned within an envelope of the edge portion 40, particularly in those embodiments where edge portion 40 material has desired wear and noise performance properties. With this approach, materials with greater fire resistance can be used without the need to be processable in the extruder screw and/or at the same time as the remaining jacket material. These preformed edge portions 40 can be made by separate extrusion, machining, lamination and other continuous processes.

Figure 8:
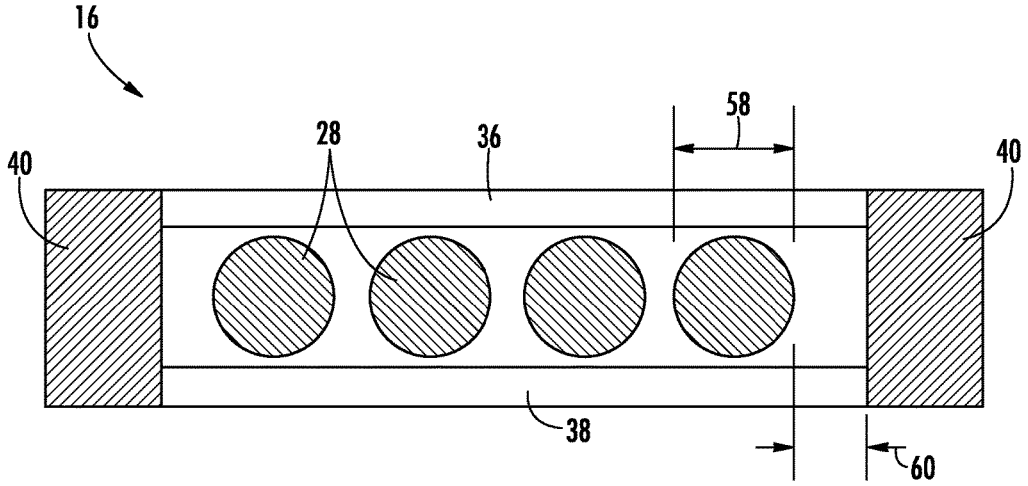
FIG. 8 is a cross-sectional view of still another embodiment of a traction elevator belt.

In another embodiment, illustrated in FIG. 8, the edge portion 40 is located at an edge distance 60 from the end cord 28 that is at least one half of a cord diameter 58 with a maximum preferred edge distance 60 of about two cord diameters 58 so that stresses imparted to the jacket material by the cord 18 as it presses the jacket 30 against the sheave is substantially reduced.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A belt for suspending and/or driving an elevator car of an elevator system comprising:

a plurality of tension members arranged in a lengthwise direction;

a jacket substantially retaining the plurality of tension members, the jacket defining a traction portion, a back portion, and an inner portion between the traction portion and the back portion; and an edge treatment at one or more lateral edges of the belt to increase fire resistance of the lateral edges, the edge treatment extending inboard partially along the traction portion and/or the back portion and mechanically interlocked with the jacket via an edge treatment leg extending into the jacket in a thickness-wise direction of the belt;

wherein the traction portion is formed from a first material and the inner portion is formed from a second material having an increased fire resistance compared to the first material.

2. The belt of claim 1, wherein the edge treatment comprises a layer of material located at one or more lateral edges of the belt having increased fire resistance relative to the traction portion.

3. The belt of claim 2, wherein the layer of material is formed from the second material.

4. The belt of claim 1, wherein the edge treatment has a C-shaped cross-section.

5. The belt of claim 1, wherein the edge treatment is preformed and secured to the jacket during formation of the jacket.

6. An elevator system comprising:

an elevator car movable along a hoistway;

a machine disposed in the hoistway to drive rotation of a traction sheave; and a belt operably connected to the elevator car and interactive with the traction sheave such that rotation of the traction sheave drives movement of the elevator car along the hoistway, the belt including:

a plurality of tension members arranged in a lengthwise direction;

a jacket substantially retaining the plurality of tension members, the jacket defining a traction portion interactive with the traction sheave, a back portion, and an inner portion between the traction portion and the back portion; and an edge treatment at one or more lateral edges of the belt to increase fire resistance of the lateral edges, the edge treatment extending inboard partially along the traction portion and/or the back portion and mechanically interlocked with the jacket via an edge treatment leg extending into the jacket in a thickness-wise direction of the belt;

wherein the traction portion is formed from a first material and the inner portion is formed from a second material having an increased fire resistance compared to the first material.

7. The elevator system of claim 6, wherein the edge treatment comprises a layer of material having increased fire resistance relative to the traction and/or back portions.

8. The elevator system of claim 7, wherein the layer of material is formed from the second material.

* * * * *